US009611083B2

(12) United States Patent
Schuttler et al.

(10) Patent No.: US 9,611,083 B2
(45) Date of Patent: Apr. 4, 2017

(54) CABLE TIE WITH SUPPORT MEMBER

(71) Applicant: Avery Dennison Retail Information Services LLC, Mentor, OH (US)

(72) Inventors: David L. Schuttler, Townsend, MA (US); Charles J. Burout, Bedford, NH (US)

(73) Assignee: AVERY DENNISON RETAIL INFORMATION SERVICES, LLC, Westborough, MA (US)

( * ) Notice: Subject to any disclaimer, the term of this patent is extended or adjusted under 35 U.S.C. 154(b) by 0 days.

(21) Appl. No.: 14/634,935

(22) Filed: Mar. 2, 2015

(65) Prior Publication Data

US 2016/0257466 A1 Sep. 8, 2016

(51) Int. Cl.
*B65D 63/10* (2006.01)

(52) U.S. Cl.
CPC ..... *B65D 63/1027* (2013.01); *Y10T 24/1498* (2015.01)

(58) Field of Classification Search
CPC B65D 63/1027; B65D 63/10; B65D 63/1018; B65D 63/1063; Y10T 24/1498
USPC ..... 24/16 PB
See application file for complete search history.

(56) References Cited

U.S. PATENT DOCUMENTS 4,805,856 A * 2/1989 Nicoli ..... F16L 3/233 24/16 PB
5,636,412 A * 6/1997 Lodi ..... B65D 63/1081 24/16 PB
5,765,885 A 6/1998 Netto
5,839,169 A * 11/1998 Edwards ..... B65D 63/1027 24/16 PB
5,964,013 A 10/1999 Bergstrom
6,449,808 B1 * 9/2002 Zappa ..... G09F 3/037 24/16 PB
6,640,393 B2 * 11/2003 Wendle ..... B65D 63/1027 24/16 PB

OTHER PUBLICATIONS

International Search Report and Written Opinion prepared for PCT/US2016/020322 dated May 3, 2016.

* cited by examiner

*Primary Examiner* — Abigail Morrell
(74) *Attorney, Agent, or Firm* — Avery Dennison Retail Information Services, LLC

(57) ABSTRACT

A unitary, plastic cable tie for use in securing an article to packaging includes an elongated, serrated strap and a support member that extend orthogonally out from opposing surfaces of an apertured head. The support member includes an enlarged, planar backing plate pivotally connected to the head through a flexible, tabular neck. In use, the cable tie is folded through the neck such that the backing plate overlies the rear wall of the head. The strap is then inserted through both a fitted slot in the backing plate and a first opening in the packaging, wrapped transversely across the article, disposed through both an enlarged opening in the backing plate and a second opening in the packaging, and into engagement with the head. In this manner, the retentive force applied by the cable tie onto the packaging is dispersed evenly across the relatively large surface area of the backing plate.

14 Claims, 3 Drawing Sheets

CABLE TIE WITH SUPPORT MEMBER

FIELD OF THE INVENTION

The present invention relates generally to cable ties and, more particularly, to cable ties designed principally for use in packaging applications.

BACKGROUND OF THE INVENTION

Cable ties, also commonly known as bundling ties and harnessing devices, are well known devices that are widely used in the art to couple together a plurality of objects, such as a group of parallel wires or cables. One type of cable tie which is well known and commonly used in the art comprises an elongated strap that is secured, at one of its ends, to an apertured head. The free end of the elongated strap is typically shaped to define a tail of narrowed width to facilitate insertion through the apertured head. A plurality of serrations, or teeth, is formed along one surface of the elongated strap along the majority of its length. Additionally, an internal pawl, or locking tang, is disposed within the apertured head and is adapted to sequentially engage the serrations on the strap.

In the retail industry, cable ties are often used to secure an article of commerce to its corresponding packaging, such as a display card or box. In this manner, the article can be displayed for sale in an aesthetically pleasing and consistent fashion. Additionally, once reliably secured to its associated packaging, the article is typically rendered less susceptible to theft or other forms of tampering.

A cable tie of the type as described above is commonly used in the following manner to secure an article of commerce (e.g. a handheld tool or toy) to its associated packaging (e.g. a generally planar display card). Specifically, the article is disposed in its desired position against the front surface of the desired packaging. A pair of narrow slots, each having the approximate dimensions of the strap in transverse cross-section, is preferably preformed or subsequently punched into the packaging on opposite sides of the article in close proximity thereto. With the head of the cable tie positioned behind the rear surface of packaging, the free end of the strap is inserted forward through one of the slots, wrapped transversely across the article, and inserted rearward through the other of the slots.

The cable tie is then formed into a closed loop by inserting the free end of the serrated strap through the apertured head. With the cable tie formed into a closed loop, the free end of the serrated strap is advanced through the apertured head until the strap cinches tightly across the article, the internal pawl lockably engaging the serrations of the strap to prevent withdrawal, or backing out, of the strap from the apertured head. In this manner, the engagement of the internal pawl onto the serrated strap secures the cinched cable tie in its closed loop configuration and thereby retains the article firmly against the front surface of the packaging.

Packaging used in the retail industry is commonly constructed out of a thick, paper-based material, such as paperboard, chipboard, cardboard or the like. Due to its paper-based construction, this type of packaging is not particularly rigid or durable in nature. Rather, it has been found that paper-based packaging is often torn or otherwise deformed prior to purchase, either in an intentional or unintentional manner.

In particular, the relatively large retentive force that is applied by a cable tie to secure an article of commerce to its packaging is typically achieved through relatively small regions of contact with the packaging. More specifically, the majority of contact made by the cable tie against the packaging is limited to (i) the region of the packaging that defines the inner side edge of each slot, and (ii) the region of the packaging in direct contact with the rear surface of the head of the cable tie. As a result, it has been found that the retentive force applied by the cable tie can cause either the strap to tear or deform the packaging about the periphery of each slot and/or the head to penetrate partially or entirely through the portion of the packaging in contact therewith. As can be appreciated, damage to the packaging in the manner described above can result in the loosening or complete disassociation of the article from its packaging, which is highly undesirable.

Accordingly, a number of different techniques are commonly utilized in the industry to prevent damage to packaging when an article of commerce is secured thereto using a cable tie.

As a first technique, it is known in the art for the packaging itself to be strengthened through the general region of contact with the cable tie by either (i) incorporating strengthening ribs or other integral reinforcement features directly into the packaging, or (ii) applying tape or another similar adhesive element against the rear surface of the packaging.

As a second technique, it is known in the art for a separate component, or insert, to be disposed between the cable tie and the packaging. The insert is typically constructed as an enlarged, unitary, planar member that is constructed out of a rigid and durable material, such as plastic. In use, the insert serves to significantly expand the region of contact applied to the packaging from the retentive force produced by the cable tie. By dispersing the retentive force applied to the packaging across a broader region of contact, the packaging is able to absorb the retentive forces without tearing.

Although useful in preventing damage to packaging when an article of commerce is secured thereto using a cable tie, the aforementioned techniques rely primarily upon the use of additional materials, components and/or assembly steps, which, as a consequence, substantially increase overall packaging costs.

SUMMARY OF THE INVENTION

It is an object of the present invention to provide a new and improved cable tie that can be used to secure an article of commerce to its corresponding packaging.

It is another object of the present invention to provide a cable tie as described above that is designed not to damage the packaging against which the article is retained.

It is yet another object of the present invention to provide a cable tie as described above that applies a retentive force to the packaging against which the article is retained through a disperse region of contact.

It is still another object of the present invention to provide a cable tie as described above that has a limited number of parts, is simple to use and is inexpensive to manufacture.

Accordingly, as a feature of the present invention, there is provided a cable tie comprising (a) a head shaped to include an elongated strap accepting channel, the head comprising a locking tang which is disposed to project into the strap accepting channel, (b) a strap having a first end and a second end, the first end being formed onto the head, the strap being dimensioned for insertion into the strap accepting channel so the cable tie forms a closed loop, the strap being adapted to be engaged by the locking tang when the tie is formed into a closed loop, and (c) a support member formed onto the head, the support member comprising a backing plate pivotally coupled to the head through a flexible neck.

Various other features and advantages will appear from the description to follow. In the description, reference is made to the accompanying drawings which form a part thereof, and in which is shown by way of illustration, an embodiment for practicing the invention. The embodiment will be described in sufficient detail to enable those skilled in the art to practice the invention, and it is to be understood that other embodiments may be utilized and that structural changes may be made without departing from the scope of the invention. The following detailed description is therefore, not to be taken in a limiting sense, and the scope of the present invention is best defined by the appended claims.

BRIEF DESCRIPTION OF THE DRAWINGS

In the drawings wherein like reference numerals represent like parts.

DETAILED DESCRIPTION OF THE INVENTION

Figure 1A:
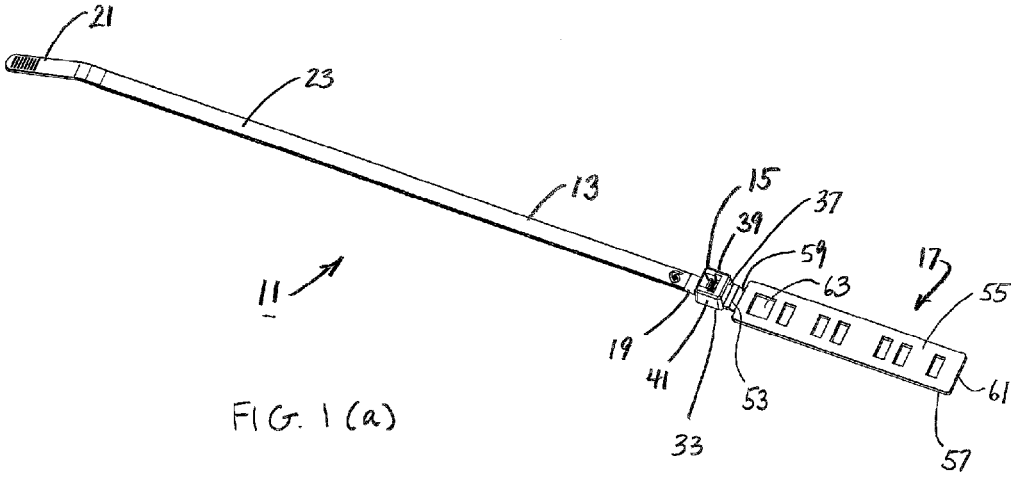
FIGS. 1(*a*) and 1(*b*) are front perspective and front plan views, respectively, of a cable tie constructed according to the teachings of the present invention.
Figure 1B:
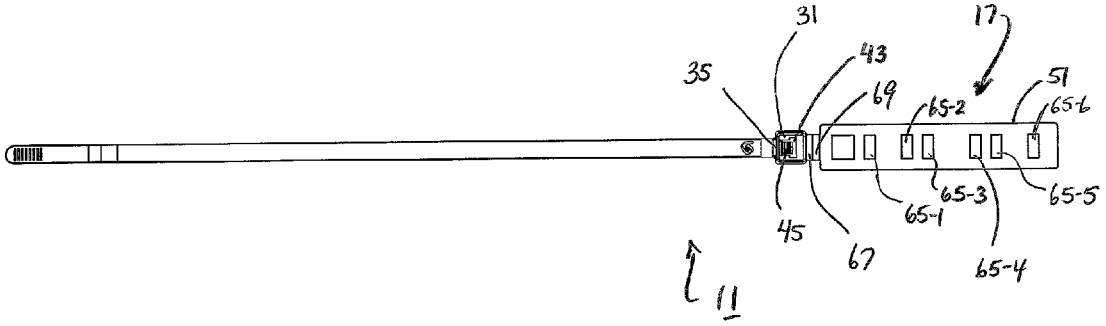

Referring now to FIGS. 1(*a*)-2(*c*), there is shown a cable tie constructed according to the teachings of the present invention, the cable tie being identified generally by reference numeral 11. In use, cable tie 11 can be formed in a closed loop configuration in order to, inter alia, secure an article of commerce to its corresponding packaging. As will be explained further in detail below, cable tie 11 is specifically designed to disperse the retentive force applied to the packaging across a broader region of contact, thereby enabling the packaging to absorb the retentive forces without tearing, which is a principal object of the present invention.

Cable tie 11 is a unitary member that comprises an elongated strap 13, a locking head 15 formed onto one end of elongated strap 13, and a support member 17 formed onto locking head 15. As will be described in detail below, support member 17 provides structural reinforcement to the packaging to which cable tie 11 is secured and thereby serves as a principal feature of the present invention.

Preferably, cable tie 11 is constructed from a durable and inexpensive plastic material (e.g. nylon, polyethylene, polypropylene, acetal, polyamide or a composite thereof) using conventional molding techniques. However, it is to be understood that cable tie 11 could be manufactured using a wide variety of alternative materials without departing from the spirit of the present invention.

Strap 13 is constructed as an elongated flexible band that has a generally uniform rectangular shape in lateral cross-section along the majority of its length. However, it is to be understood that strap 13 could be constructed in alternative shapes and configurations without departing from the spirit of the present invention.

Strap 13 comprises a first end 19, a second end 21, a substantially flat front surface 23, a bottom surface 25 and a pair of opposing, longitudinally extending side members, or rails, 27-1 and 27-2. As seen most clearly in FIG. 2(*a*), a plurality of ratchet-shaped teeth 29 are integrally formed into bottom surface 25 along the majority of its length, each tooth 29 extending laterally across bottom surface 25 between side members 27-1 and 27-2. As will be explained further below, teeth 29 are designed to be sequentially engaged by locking head 15 when cable tie 11 is formed into a closed loop configuration.

As seen most clearly in FIGS. 1(*a*) and 1(*b*), locking head 15 is constructed as an enlarged, rectangular block, or buckle, that is shaped to include a front wall 31, a rear wall 33, an inner end wall 35, an outer end wall 37, a left sidewall 39, and a right sidewall 41 that together define an elongated strap accepting channel 43 that extends through head 15 from front wall 31 to rear wall 33.

As can be seen, first end 19 of strap 13 is integrally formed onto the outer surface of inner end wall 35 and extends generally orthogonally out therefrom. Furthermore, elongated channel 43 is generally rectangular in transverse cross-section and is appropriately dimensioned to fittingly receive a section of strap 13 when tie 11 is formed into a closed loop.

Locking head 15 additionally comprises a deflectable pawl, or locking tang, 45 that is pivotally coupled to the inner surface of inner end wall 35 along rear wall 33. Pawl 45 is naturally oriented to project into elongated channel 43 and selectively engage strap 13 when inserted into locking head 15, as will be explained further below.

Pawl 45 is preferably constructed as generally a block-shaped member that includes a plurality of ratchet-shaped teeth at its distal end. In this manner, it is intended that multiple teeth on pawl 45 engage corresponding teeth 29 on strap 13 to maximize the strength of engagement between locking head 15 and strap 13 when cable tie 11 is formed into a closed loop configuration. However, it is to be understood that alternative styles of pawls, such as relatively flat, planar members, could be utilized in place of pawl 45 without departing from the spirit of the present invention.

Referring now to FIGS. 1(*a*), 1(*b*) and 2(*c*), support member 17 includes a backing plate 51 that is pivotally connected to the outer surface of outer end wall 37 by a flexible neck 53. As will be explained further below, backing plate 51 can be used to provide support to packaging to which cable tie 11 is secured, thereby reducing the risk of any damage to the packaging.

Backing plate, or pad, 51 is constructed as an enlarged, rectangular, planar platform that includes a flattened front surface 55, a flattened rear surface 57, an inner edge 59 and an outer edge 61. As can be seen, backing plate 51 has a width that is slightly greater than the width of locking head 15 and a length that is considerably longer than the length of locking head 15. The enlarged overall footprint of backing plate 51 creates a relatively broad, or disperse, region of contact against the packaging to which cable tie 11 is secured, which is highly desirable for reasons to be explained further below.

It should be noted that backing plate 51 is not limited to a rectangular shape. Rather, it is to be understood that backing plate 51 could be formed into alternative configurations (e.g. as a square-shaped or disc-shaped member with an enlarged, planar, front surface) without departing from the spirit of the present invention.

Figure 2A:
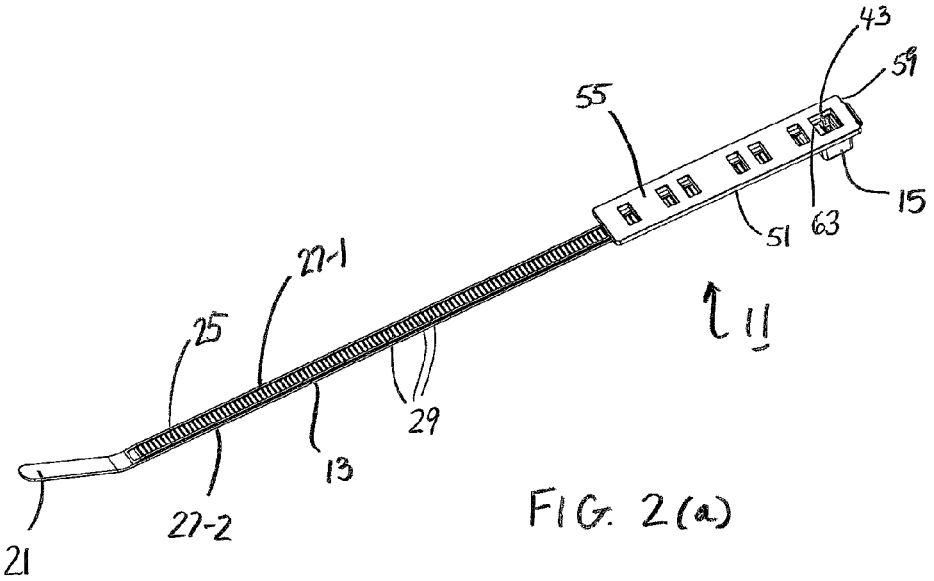
FIGS. 2(*a*)-(*c*) are rear perspective, right side plan, and front plan views, respectively, of the cable tie shown in FIG. 1(*a*), the cable tie being shown with its support member folded about its neck so as to abut against the rear wall of the head and a portion of the rear surface of the strap.
Figure 2B:
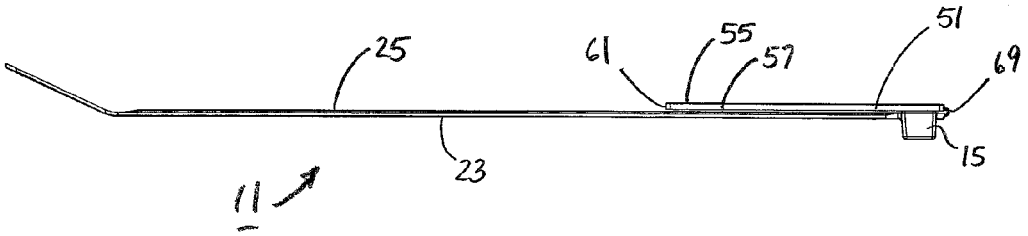
Figure 2C:
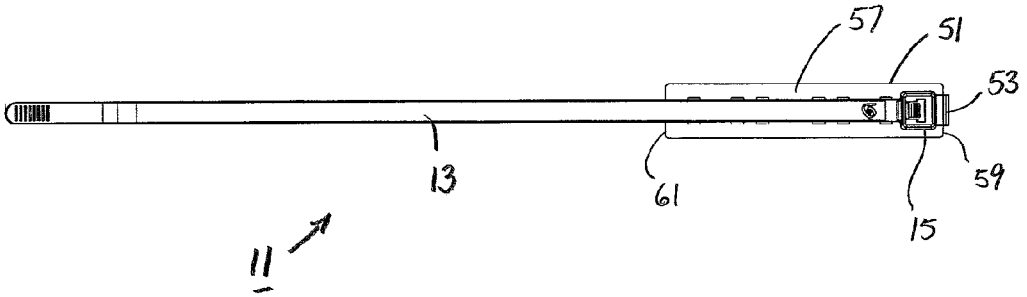

Backing plate 51 is shaped to define an enlarged transverse hole, or opening, 63 in close proximity to inner edge 59. Opening 63 is positioned to directly align with strap accepting channel 43 when backing plate 51 is pivoted rearward about neck 53 and into contact against bottom surface 25 of strap 13 and rear wall 33 of locking head 15, as shown in FIG. 2(*a*). Preferably, opening 63 has the same general dimensions in transverse cross-section as strap accepting channel 43 at rear wall 33 so that backing plate 51 does not interfere with the insertion of strap 13 through apertured locking head 15.

Backing plate 51 is additionally shaped to define a plurality of transverse slots 65-1 thru 65-6 that are formed in parallel in plate 51 at various locations along its length. Each slot 65 preferably has the same general dimensions in transverse cross-section as strap 13. As such, strap 13 is appropriately dimensioned to be fittingly inserted through one of slots 65 when tie 11 is formed into its closed loop configuration, as will be explained further below.

As seen most clearly in FIGS. 1(*a*) and 1(*b*), neck 53 is a shortened tabular member that connects outer end wall 37 of locking head 15 to inner edge 59 of backing plate 51, the width of neck 53 being approximately equal to the width of strap 13. Neck 53 includes a stiffened, or rigid, inner portion 67 that forms the connection with outer end wall 37 and a flexible outer portion 69 that forms the connection with backing plate 51.

Inner portion 67 preferably has the same approximate thickness and rigidity as strap 13. By contrast, outer portion 69 preferably has a thickness that is considerably less than the thickness of strap 13. As a result, cable tie 11 is designed to flex through reduced thickness portion 69. In this manner, neck 53 functions as a living hinge through which backing plate 51 can pivot relative to locking head 15.

Cable tie 11 is initially constructed such that backing plate 51 extends orthogonally out from outer end wall 37 and lies in a generally coplanar relationship with strap 13, as shown in FIGS. 1(*a*) and 1(*b*). In other words, front surface 55 of backing plate 51 lies in the same plane defined by front surface 23 of strap 13 and rear surface 57 of backing plate 51 lies in the same plane defined by bottom surface 25 of strap 13.

At the same time, the hinged construction of neck 53 enables backing plate 51 to be pivoted rearward until rear surface 57 of backing plate 51 contacts both rear wall 33 of locking head 15 and a section of bottom surface 25 of strap 13, as shown in FIGS. 2(*a*)-(*c*). Disposed in this folded condition, cable tie 11 is able to secure an article of commerce to its corresponding packaging without imparting any damage to the packaging, which is a principal object of the present invention.

In use, tie 11 can be used in the following manner to secure an article of commerce to its corresponding packaging. As referenced above, cable tie 11 is initially constructed such that backing plate 51 extends orthogonally out from outer end wall 37 so as to lie in a generally coplanar relationship with strap 13, as shown in FIGS. 1(*a*) and 1(*b*). Once desired for use, backing plate 51 is pivoted rearward such that rear surface 57 of backing plate 51 is drawn towards rear wall 33 of locking head 15 and bottom surface 25 of strap 13, as shown in FIGS. 2(*a*)-(*c*).

With the article of commerce disposed in position against the front surface of its corresponding packaging, exposed front surface 55 of backing plate 51 is disposed against the rear surface of the packaging. More specifically, backing plate 51 is preferably disposed against the rear surface of the packaging such that inner edge 59 and outer edge 61 are aligned on opposite sides of the article to be coupled.

Figure 3C:
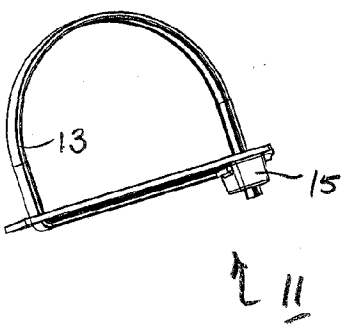
FIGS. 3(*a*)-(*c*) are front perspective, right side plan, and right side perspective views, respectively, of the cable tie shown in FIG. 1(*a*), the cable tie being shown formed into a closed loop configuration.
Figure 3B:
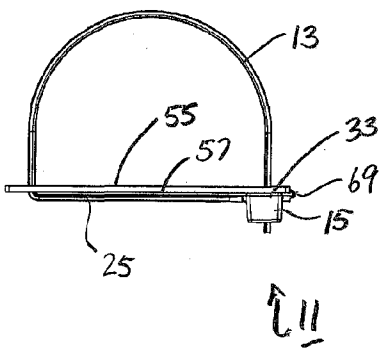
Figure 3A:
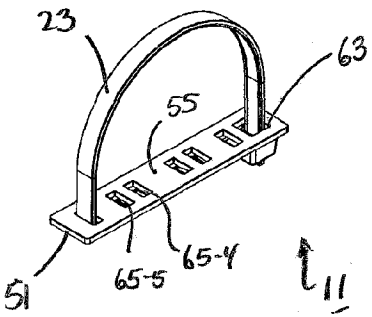

Free end 21 of strap 13 is then inserted through a slot 65 in backing plate 51 (i.e. in the direction from rear surface 57 to front surface 55), as shown in FIGS. 3(*a*)-(*c*). With strap 13 pulled taut through slot 65, rear surface 57 of backing plate 51 abuts firmly against rear wall 33 of locking head 15 as well as against a section of bottom surface 25 of strap 13.

Free end 21 of strap 13 is then passed forward through the packaging on one side of the article. Preferably, a first narrow opening is formed in the packaging to facilitate insertion of strap 13 therethrough. Strap 13 is then wrapped transversely across the article and inserted rearward through a second narrow opening formed in the packaging.

Preferably, strap 13 is initially positioned such that opening 63 in backing plate 51 directly aligns with the second narrow opening formed in the packaging, thereby facilitating insertion of second end 21 of strap 13 through strap accepting channel 43. Additionally, strap 13 is preferably inserted through the particular slot 65 in backing plate 51 that is in closest alignment with the first narrow opening in the packaging. In this manner, it is to be understood that the inclusion of a plurality of parallel slots 65 in backing plate 51 enables strap 13 to wrap tightly around articles of varying widths. In this manner, it is envisioned that cable tie 11 could be utilized in a wide variety of potential applications.

Cable tie 11 is formed into a closed loop by inserting free end 21 of strap 13 through strap accepting channel 43 in in locking head 15, as seen in FIGS. 3(*a*)-(*c*). With cable tie 11 formed into a closed loop, free end 21 of serrated strap 13 is advanced through locking head 15 until strap 13 cinches tightly across the article, with pawl 45 lockably engaging ratchet-shaped teeth 29 to prevent withdrawal, or backing out, of strap 13 from locking head 15. As such, the engagement of pawl 45 onto strap 13 secures cinched cable tie 11 in its closed loop configuration and thereby retains the article firmly against the front surface of the packaging.

With tie 11 configured in the manner set forth in detail above, the entire front surface 55 of backing member 51 is disposed in contact against the packaging. As a result, the relatively large surface area of front surface 55 disperses the region of contact between cable tie 11 and the packaging. By significantly expanding this region of contact, the retentive force applied by cable tie 11 onto the packaging is less concentrated, thereby reducing the likelihood of damage to packaging as compared with conventional cable ties (i.e. cable ties that do not include a support member).

The embodiment shown above is intended to be merely exemplary and those skilled in the art shall be able to make numerous variations and modifications to it without departing from the spirit of the present invention. All such variations and modifications are intended to be within the scope of the present invention as defined in the appended claims.

What is claimed is:

1. A cable tie comprising:

(a) a head including an elongated strap accepting channel, the head comprising a locking tang projecting into the strap accepting channel;

(b) a strap having a first end and a second end, the first end being formed onto the head, the strap being dimensioned for insertion into the strap accepting channel so the cable tie forms a closed loop, the strap being adapted to be engaged by the locking tang when the tie is formed into the closed loop, and (c) a support member formed onto the head, the support member comprising a backing plate that has a width greater than a width of the head and a length longer than a length of the head, the backing plate defines a plurality of transverse slots that are arranged in parallel, each slot dimensioned to fittingly receive the strap, and the backing plate is pivotally coupled to the head through a flexible neck and the backing plate defines at least one transverse hole that aligns with the strap accepting channel in the head when the cable tie is folded about the flexible neck.

2. The cable tie as claimed in claim 1 wherein the cable tie is constructed as a unitary plastic member.

3. The cable tie as claimed in claim 2 wherein the backing plate is planar.

4. The cable tie as claimed in claim 3 wherein the backing plate has a rectangular footprint.

5. The cable tie as claimed in claim 2 wherein the backing plate includes a substantially flat front surface, a substantially flat rear surface, an inner edge and an outer edge.

6. The cable tie as claimed in claim 5 wherein the head includes a front wall, a rear wall, an inner end wall, an outer end wall, and a pair of sidewalls that together define the elongated channel.

7. The cable tie as claimed in claim 6 wherein the flat front surface of the backing plate is greater in surface area than the front wall of the head.

8. The cable tie as claimed in claim 7 wherein the backing plate is formed onto and extends orthogonally out from the outer end wall of the head.

9. The cable tie as claimed in claim 8 wherein the neck connects the inner edge of the backing plate to the outer end wall of the head.

10. The cable tie as claimed in claim 9 wherein at least a portion of the neck has a thickness that is less than a thickness of the strap.

11. The cable tie as claimed in claim 8 wherein the cable tie is adapted to be folded about the flexible neck such that the rear surface of the backing plate abuts against the rear wall of the head.

12. The cable tie as claimed in claim 1 wherein the backing plate defines at least one transverse slot that is dimensioned to fittingly receive the strap.

13. The cable tie as claimed in claim 1 wherein the strap is in the form of an elongated flexible band comprising a front surface and a bottom surface.

14. The cable tie as claimed in claim 13 wherein a plurality of ratchet-shaped teeth are formed onto the bottom surface of the strap, the plurality of ratchet-shaped teeth being designed to be sequentially engaged by the locking tang when the cable tie is formed into the closed loop.

* * * * *